United States Patent [19]

Cannata

[11] Patent Number: 4,584,986

[45] Date of Patent: Apr. 29, 1986

[54] POSITIVE INTERCONNECT SYSTEM FOR FIREPLACE INSERTS

[76] Inventor: Joseph M. Cannata, 646 Gloucester Dr., Highland Heights, Ohio 44143

[21] Appl. No.: 708,061

[22] Filed: Mar. 4, 1985

[51] Int. Cl.[4] ..... F24B 7/00

[52] U.S. Cl. ..... 126/123; 126/120; 126/318

[58] Field of Search ..... 126/123, 126, 120, 307 R, 126/314, 315, 318; 138/107, 113, 120, 155; 248/339, 342

[56] References Cited

U.S. PATENT DOCUMENTS

| | | | |
|---|---|---|---|
| 964,642 | 7/1910 | Hall | 126/318 |
| 1,455,027 | 5/1923 | Ludwig | 126/307 R X |
| 2,791,213 | 5/1957 | Goulding, Sr. | 126/123 |
| 4,026,264 | 5/1977 | Henriques | 126/123 |
| 4,422,439 | 12/1983 | Hunt | 126/318 X |
| 4,424,794 | 1/1984 | Page | 126/123 |

FOREIGN PATENT DOCUMENTS

| | | | |
|---|---|---|---|
| 3013744 | 10/1981 | Fed. Rep. of Germany | 126/307 R |

*Primary Examiner*—Randall L. Green

*Attorney, Agent, or Firm*—Renner, Kenner, Greive, Bobak & Taylor

[57] ABSTRACT

A positive interconnect system (10) for a fireplace insert (11). The primary portion (10A) of the interconnect (10) incorporates a support frame (30) that is suspended from the damper frame (12) by a plurality of non-extendable hangers (39, 40, 41 and 42). Wholly separate and distinct means (83 and 84) are provided to support the connector duct (82) and sealing means (80, 94) from the support frame (30) in order to enhance the fore and aft as well as the lateral adjustability of the primary portion (10A) of the system. Slidable collar means (115) provide selective connection with the vent (75) of the insert (11). A secondary portion (10B) communicates through the smoke chamber (26) between the primary portion (10A) and the flue (22). An adaptor boot (200) seals around the mouth (201) of the flue (22) and converts the cross-sectional dimension of the flue to the cross-sectional dimension of the duct system (202, 251, 258) that extends between the adaptor boot (200) and the damper frame (12). Means (223, 224) are provided to manipulate the adaptor boot (200) into operative position and thereafter wedge against the shelf (25) forming the floor of the smoke chamber (26) to support the secondary portion (10B) in its operative position.

9 Claims, 11 Drawing Figures

POSITIVE INTERCONNECT SYSTEM FOR FIREPLACE INSERTS

TECHNICAL FIELD

The present invention relates generally to positive interconnect arrangements for fireplace inserts. More particularly, the present invention relates to a positive interconnect system having a primary portion which communicates between the insert and the fireplace damper, and a secondary portion which may be employed, if desired, to communicate between the damper and the flue liner of the chimney. Specifically, the positive interconnect system employs a support frame that is simply suspended from the damper frame by hanger means, and the primary portion of the positive interconnect system is, in turn, suspended from the support frame by virtue of means wholly independent of the hanger means. The secondary portion of the positive interconnect is independently supported from the shelf forming the floor of the smoke chamber.

BACKGROUND OF THE INVENTION

The advent of central heating relegated the fireplace to a decorator's item. The relatively recent reality regarding the uncertainty as to the quantity and cost of fossil fuels has necessitated a rethinking as to how the fireplace might be employed as at least a supplemental heat source.

The heat emanating from the fireplace may warm those sitting in close proximity thereto, and its radiant energy may tend to warm the immediate room, but the operating fireplace induces an air flow which reduces the overall heating efficiency of the primary heat source. So long as the fireplace is operating there is an endless trail of warm, expensive household air racing up the chimney. For years no one objected. Energy to operate the central heating system was available in abundance, and at relatively low cost.

Gradually it became apparent that the world's fuel supplies did not issue forth from a cornucopia; rather, the supply was finite; some fuels, such as wood, could be replenished if its source were carefully husbanded, but overall the cost of fossil fuels continued to rise. By the early 1970's the crunch was widely felt.

Many people boarded up their fireplaces; some closed and sealed the dampers to their fireplaces; and, other judiciously operated their fireplaces only on those days when the resultant overall loss of heat would not be sorely felt. This created the paradox of not being able to use the fireplace on truly cold days.

It is estimated that there are currently in excess of twenty million masonry fireplaces in the United States, and with that available market the fireplace insert was developed. The fireplace insert converts the outmoded fireplace into a valuable secondary heat source and still permits man the luxury of fulfilling the primordial instinct of watching a crackling fire while basking in its cozy warmth.

Currently, manufacturers are providing fireplace inserts in a wide variety of models. Initially, a self-contained firebox was simply inserted into the old fireplace opening, and a shroud was fitted between the insert and the facing of the original fireplace opening to minimize the undesirable exiting air flow. However, this arrangement has two major drawbacks. Not only is an effective seal between the insert and the old fireplace opening virtually impossible to effect, but such an arrangement inherently exposes the exhaust gases to an excessive surface area which serves to cool the exhaust gases allowing them to condense and deposit creosote within the old fireplace as well as upwardly along the interior of the chimney. Creosote deposits are a natural fire hazard and must be avoided.

Both drawbacks can be greatly minimized by the use of a positive interconnect system that extends at least between the exhaust vent of the insert and the damper frame. Such positive interconnect systems have heretofore been employed, but they are rather difficult to install.

In addition, it may also be desirable to effect a direct, enclosed flow path from the damper to the flue liner in the chimney. A smoke chamber is normally provided between the damper and the flue of the chimney, and the use of an enclosed flow path therethrough can eliminate any tendency for creosote to be deposited on the walls of the smoke chamber. The enclosed flow path from the damper to the flue also tends to maintain a higher flue temperature which serves to increase the draft action of the chimney and results in a further improved performance of the insert.

Heretofore, a corrugated connector duct has been employed to effect the enclosed flow path from the damper to the flue, and while such an arrangement is very attractive when depicted on sales brochures, the actual installation requires that the duct be bent in an S-shaped curve during installation. Chimney dimensions and layouts are not standard, and that precludes pre-shaping the corrugated duct work. In fact, the majority of chimney layouts even prevent the duct from being shaped prior to insertion. As a result, the installer must attempt to bend the corrugated duct after it is partially inserted through the damper, and it must be appreciated that he is attempting to bend the portion already inserted. This is a difficult task, at best, and virtually impossible in some chimneys because of their interior configuration.

SUMMARY OF THE INVENTION

It is, therefore, a primary object of the present invention to provide an improved, positive interconnect system between at least the fireplace insert and the damper.

It is another object of the present invention to provide a positive interconnect system, as above, that can be readily installed from the damper to the flue.

It is a further object of the present invention to provide a positive interconnect system, as above, that can be readily installed to accommodate dimensional and layout variations between the fireplace insert, the damper and the flue liner.

It is yet another object of the present invention to provide a positive interconnect system, as above, that is relatively inexpensive to manufacture and which can be inserted with a minimal number of standard hand tools.

These and other objects of the invention, as well as the advantages thereof over existing and prior art forms, will be apparent in view of the following detailed description of the attached drawings and are accomplished by means hereinafter described and claimed.

In general, a positive interconnect embodying the concept of the present invention employs a support frame. A plurality of inextendable hanger means acting in opposed pairs simply suspend the support frame from the damper frame located at the passage between the fireplace cavity and the smoke chamber. A connector duct and collar means depend downwardly from the support frame to interconnect with the vent of the fireplace insert, and means by which to effect a seal between the connector duct and the masonry beneath the damper frame are disposed beneath the support frame. Means are provided by which to secure the connector duct and the seal means to the support frame, but those securing means are wholly separate and distinct from the hanger means by which the support frame is suspended from the damper frame.

The secondary portion of the positive interconnect system employs an adaptor boot which seals to the mouth of the flue and effects a dimensional transition from the cross-section of the flue to the cross-section of the duct work which connects between the adaptor boot and damper. Means are interconnected to the adaptor boot whereby not only to manipulate the boot into its proper disposition at the mouth of the flue but also thereafter to wedge against the shelf at the base of the smoke chamber to maintain the adaptor boot, and the duct work extending downwardly therefrom, in its proper operative position.

DESCRIPTION OF AN EXEMPLARY EMBODIMENT

Figure 1:
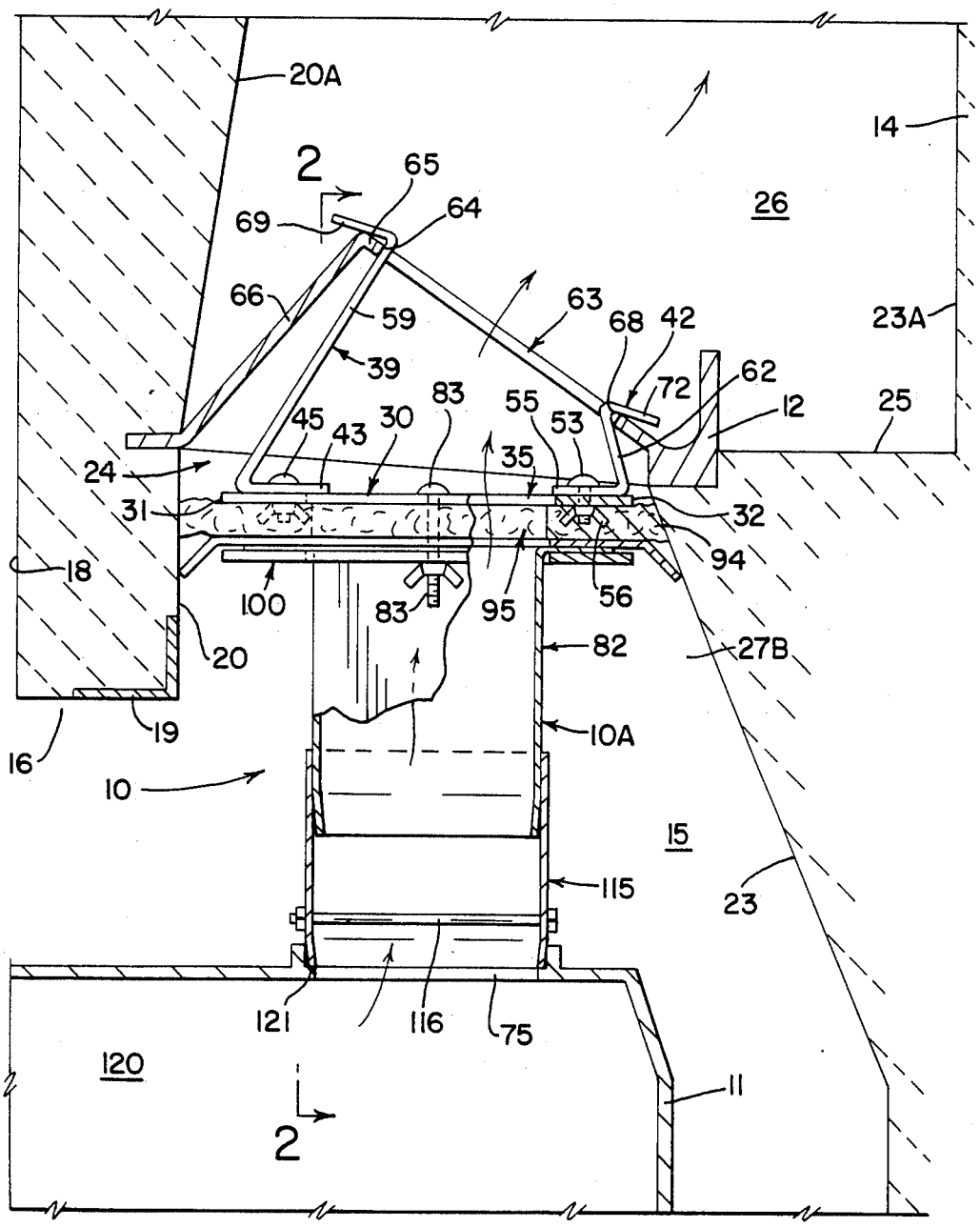
FIG. 1 is a vertical cross-section depicting that portion of a positive interconnect system embodying the concept of the present invention connected between a fireplace insert and the damper frame of the fireplace.

A positive interconnect system embodying the concept of the present invention is designated generally by the numeral 10 on the attached drawings and, for convenience, can be thought of as a primary portion 10A (FIGS. 1 through 3) which connects between a fireplace insert 11 and the damper frame 12 and a secondary portion 10B (FIGS. 4 through 7) which connects between the damper frame 12 and the flue 13 of chimney 14.

Figure 2:
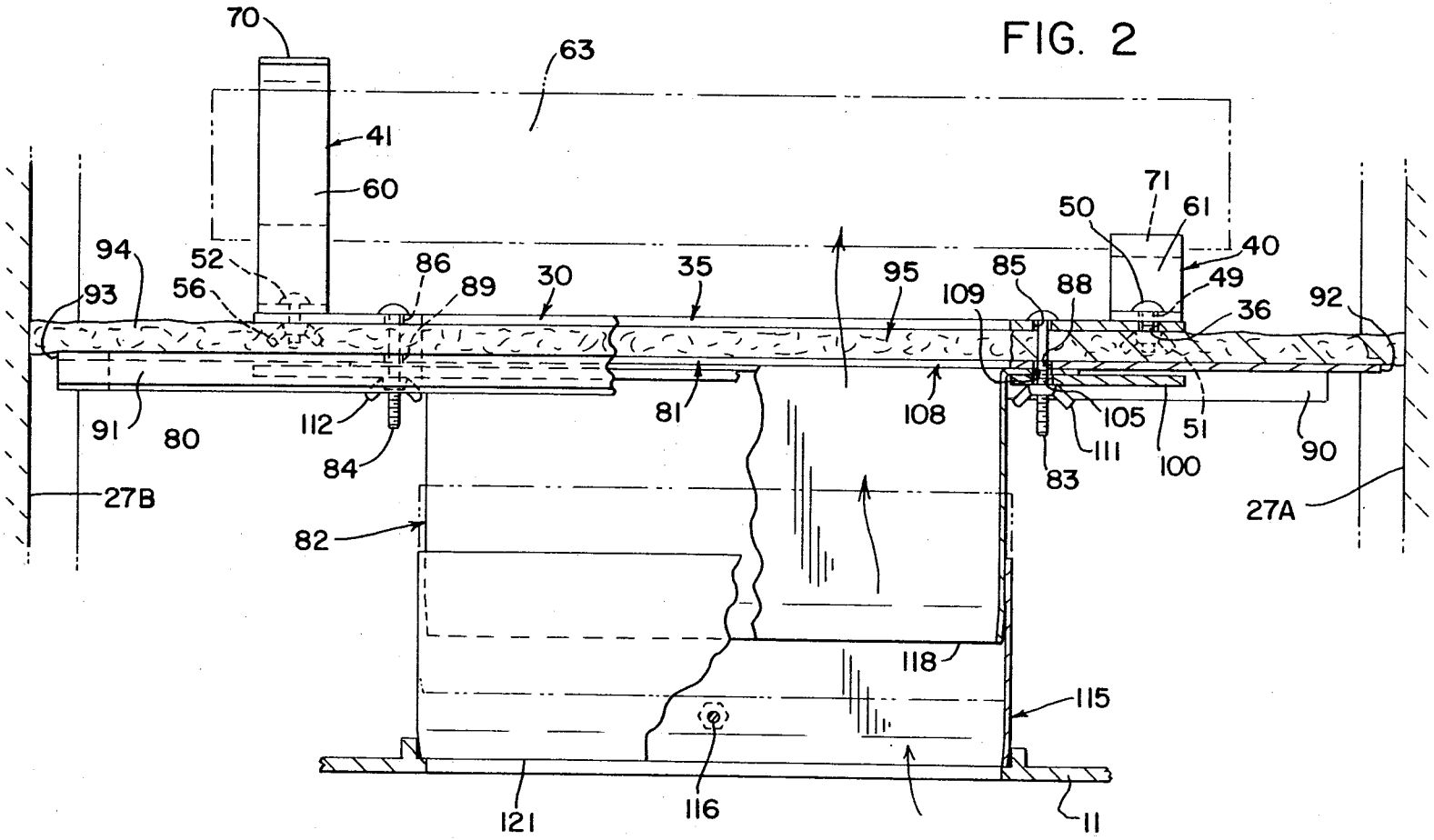
FIG. 2 is a transverse, vertical cross-section taken substantially along line 2—2 of FIG. 1.

As is perhaps most clearly seen from FIG. 1, the chimney 14 has a fireplace recess 15 surrounded by an opening 16 that may be faced (as at 18) as desired. A lintel 19, such as the angle iron depicted, spans the opening 16 and supports the facing 18. A front wall 20 extends vertically upwardly from the lintel 19 to approximately the level of the damper frame 12 and then it corbels, as at 20A, rearwardly and upwardly to the flue liner 22 within the flue 12 of the chimney 14.

The rear wall 23 of the fireplace recess 15 converges upwardly and forwardly toward the front wall 20 to define a throat 24 across which the damper frame 21 is supported. At approximately the level of the damper frame 12 the rear wall 23 abruptly recedes as a shelf 25, and then continues, as at 23A, generally vertically upwardly as the chimney to the flue liner 22.

The cavity within the chimney 14, defined generally by the shelf 25, the front wall 20A and the rear wall 23A as well as the converging side walls 27A and 27B is the smoke chamber 26.

Figure 3:
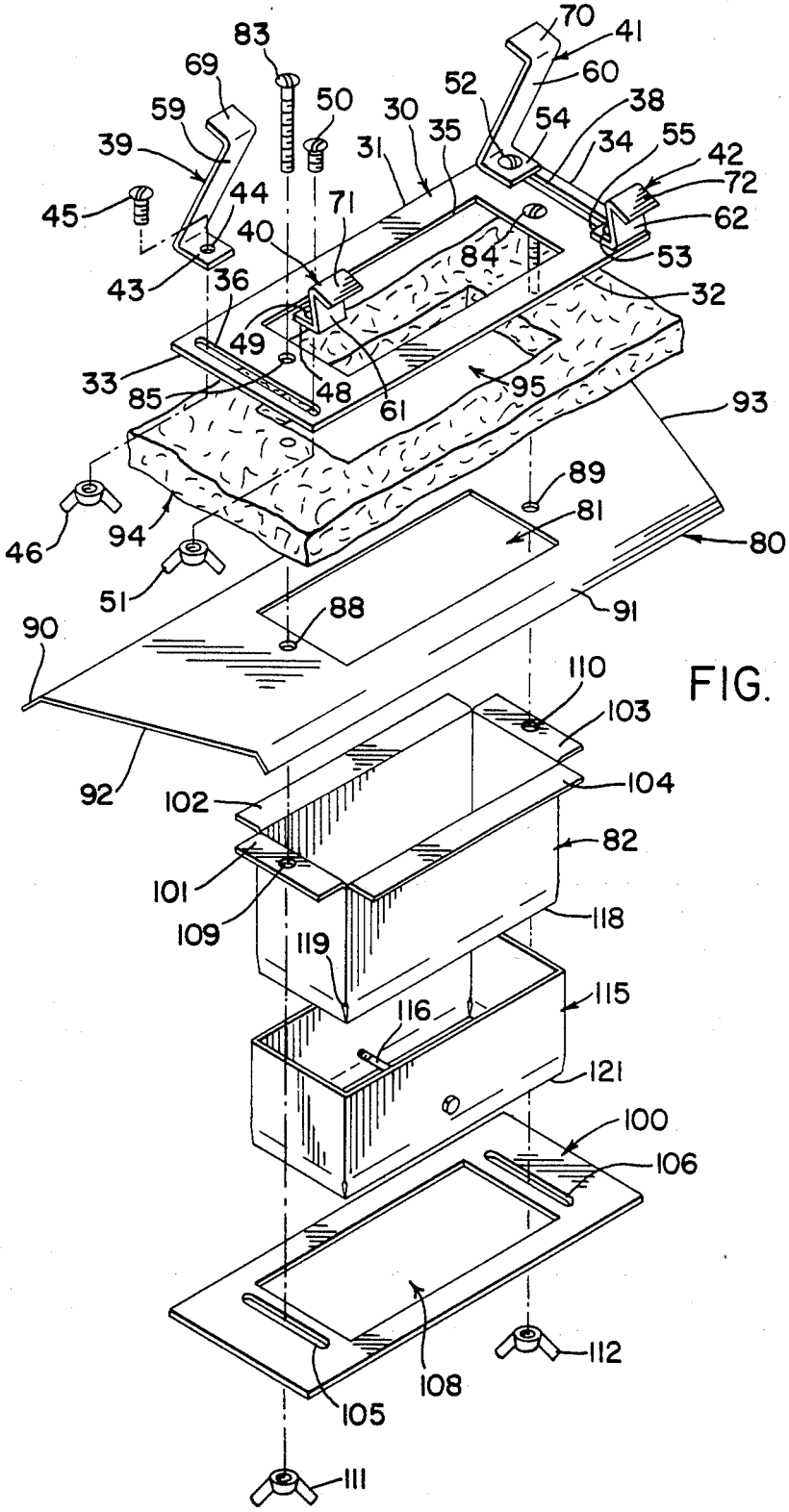
FIG. 3 is an exploded perspective depicting that portion of the positive interconnect system depicted in FIGS. 1 and 2.

Portion 10A of the positive interconnect system is connected to the damper frame 12 by the arrangement that is perhaps best depicted in FIG. 3.

A rigid, preferably flat, support frame 30 has a rectilinear outer perimeter defined by the lateral edges 31 and 32 and the ends 33 and 34. A rectilinear opening 35 is provided through the generally central portion of the support frame 30. A pair of slots 36 and 38 extend transversely with respect to the lateral edges 31 and 32 and are located in proximity to the ends 33 and 34. Each of the four Z-bar hangers 39, 40, 41 and 42 are secured to the support frame 30 by nut and bolt combinations that cooperate with the slots 36 or 38, as appropriate, to permit the Z-bar hangers to be selectively positioned therealong. Each slot mounts to Z-bar hangers as follows.

The base 43 of Z-bar hanger 39 is bored, as at 44, to receive a bolt 45. The bolt 45 extends slidably through the slot 36 to receive a wing nut 46 whereby the Z-bar hanger 39 can be secured to the support frame 30 at any desired location along the slot 36.

The base 48 of Z-bar hanger 40 is similarly bored as at 49, to receive a bolt 50 that also extends slidably through the slot 36 to receive a wing nut 51 whereby the Z-bar hanger 40 may also be selectively secured along the slot 36.

Z-bar hangers 41 and 42 are mounted along the slot 38 in the same manner by bolts 52 and 53, respectively, passing through bores 54 and 55 in conjunction with which bolt wing nuts 56 and 58 (FIGS. 1 and 2) are similarly employed.

Z-bar hangers 39 and 41 are provided with diagonals 59 and 60, respectively, that are substantially longer than are the diagonals 61 and 62 of Z-bar hangers 40 and 42, respectively.

As best seen in FIG. 1, the standard damper frame 12 has an opening 63 that is inclined with respect to a horizontal frame of reference in order to permit an easily effected swing of the plate (not shown) that is employed to open and close the damper when the latter is employed in a standard fireplace,—i.e., without the insert 11. As such, the forward edge 64 of the opening 63 is defined by a flange 65 that extends inwardly from the housing 66 of the damper frame 12 at a higher level than the rearward edge 68 of the opening 63. The longer and shorter Z-bar hangers accommodate to the inclined disposition of the opening 63 and permit the support frame 30 to be suspended from the damper frame 12 in a generally horizontal disposition.

Specifically, because of the longer diagonals 59 and 60, the engaging ends 69 and 70 of Z-bar hangers 39 and 41 can be hooked over the flange 65 while the engaging ends 71 and 72 presented from the shorter diagonals 61 and 62 of Z-bar hangers 40 and 42 hook over the rearward edge 68 of the opening 63 to effect a disposition of the support frame 30 in a generally horizontal plane. Even though the Z-bar hangers may be fashioned from steel bar stock, the angularity between the bases 43, 48, 54 and 55 and the diagonals 59, 61, 60 and 62, as well as the angularity between the diagonals 59, 61, 60 and 62 and the engaging ends 69, 71, 70 and 72 can be adjusted on the job site to accommodate variations encountered in the chimney arrangement when installing the support frame 30. This minimal adjustability, and the resulting ease of installation are also enhanced by being able selectively to locate not only the Z-bar hangers 35 and 40 along slot 36 but also the Z-bar hangers 41 and 42 along slot 38. The slots 36 and 38 thereby accommodate a selective disposition of the Z-bar hangers with respect to the support frame 30, but of perhaps equal importance, the slots 36 and 38 also permit fore and aft adjustment of the support frame 30 with respect to the damper frame 12 and/or the fireplace recess 15, as desired.

As depicted in FIG. 1, the lateral edges 31 and 32 of the support frame 30 need not engage the masonry within the fireplace recess 15 effectively to serve its purpose, but in some installations the configuration of the recess 15 will likely be such that one, or even both, edges 31 and 32 may engage the masonry without deleteriously affecting the installation or operation of the support frame 30.

It should also be noted that the Z-bar hangers, by being moved laterally within the opening 63, will permit some lateral adjustment in the location of the support frame 30 with respect to the opening 63 and the damper frame 12. This may be required in the event that the damper opening 63 is not laterally centered with respect to the fireplace recess 15 as well as in the event that the exhaust vent 75 in the insert 11 is not itself laterally centered with respect to the insert 11, or both.

With the support frame 30 adjustably positioned with respect to the damper opening 63 and the fireplace recess 15, the wing nuts are tightened onto the four (4) bolts 45, 50, 52 and 53 to secure the support frame 30 in its selected position. Thereafter, the sealing plate 80 is positioned.

The sealing plate 80 is preferably fabricated from relatively thin gauge, stainless steel that can be cut and bent with comparative ease on the job site. The sealing plate 80 is provided with a centrally located opening 81 that closely accommodates a standard size, rectilinear duct, such as the connector duct 82. A standard cross-section for such duct measures approximately 3½ by 14 inches (8.89×35.56 cm) and the opening 81 is preferably of approximately that same dimension. The location of the sealing plate 80 with respect to support frame 12 is determined by the location of the exhaust vent 75 in the insert 11. Preferably, the opening 81 is disposed directly above the vent 75.

The sealing plate 80 is supported from the support frame 30 by securing means that may preferably comprise a pair of bolts 83 and 84 which extend through appropriate bores 85 and 86 in the support frame 30 to be received through appropriately located bores 88 and 89 in the sealing plate 80. To provide for as much adjustability as possible in the location of the sealing plate 80, the bores 88 and 89 may be conveniently drilled at the installation site.

The lateral edges 90 and 91 of the sealing plate 80 may be inclined, or bent, as shown, to engage the front and rear walls 20 and 23, respectively, of the fireplace recess 15, as required, to assure accommodation with those walls. The disposition of the edges 90 and 91 may be preshaped, as depicted in FIG. 3, but in view of the wide variation encountered in the field it is preferred that the sealing plate 80 be of such a gauge that it can be easily bent at the installation site, as by a hand brake. Similarly, too, the use of relatively thin gauge metal also permits the lateral length of the sealing plate 80 to be cut at the installation site, as by tinsnips. The ends 92 and 93 are cut on the bias, as depicted in FIG. 3, to conform with the typically tapered sidewalls 27A and 27B of the fireplace recess 15.

After the bores 88 and 89 have been properly located and drilled in the sealing plate 80, a bat 94 of high temperature insulation may be pressed over the bolts 83 and 84. The fitted sealing plate 80 is then also positioned on the bolts 83 and 89. With these components so positioned, a sharp knife may be employed to cut the opening 95 through the insulation bat 94 by using the opening 81 in the plate 80 as the template. When the plate 80 is secured to the frame 30 the insulation bat 94 will effect a virtually air-tight seal with all sides of the fireplace recess 15 just beneath the support frame 30 that is hung from the damper frame 12.

A rigid, substantially flat retainer plate 100 is also received over the bolts 84 and 85 to secure the sealing plate 80 into position. In addition, the horizontally oriented mounting flanges 101, 102, 103 and 104 of a rectilinear connecting duct 82 are also interposed to be sandwiched with the sealing plate 80 between the retainer plate 100 and support frame 30.

Because the retainer plate 100 has substantial thickness, it could be inconvenient to drill holes at the installation site. Thus, to obviate that inconvenience, and yet to accommodate the required fore and aft positioning of the connector duct 82, as may be necessary for it to align with the exhaust vent 75 in the insert 11, a pair of slots 105 and 106 are provided in the retainer plate 100 to receive the bolts 84 and 85.

In order for the flanges 101 through 104 to be interposed between the retainer plate 100 and the support frame 30, the rectilinear opening 108 in the retainer plate 100 is sized to receive the rectilinear cross-section of the connector duct 82, the typical dimensions for which are stated above.

Once the desired fore and aft position of the retainer plate 100 is determined, appropriate bores 109 and 110 are drilled through the respective flanges 101 and 103 of the connector duct 82, and the assembly can be secured together with wing nuts 111 and 112, as best seen from FIG. 1.

To effect the desired connection between the vent 75 of the insert 11, and the duct 82, a sleeve 115 is received over the connector duct 82 to be slidable axially therealong. The sleeve 115 is formed with substantially the same cross-sectional dimension as the rectilinear connector duct 82 but is only sufficiently larger as to permit the sleeve to be received over the duct 82 and slid upwardly until the crosspin, in the form of a nut and bolt combination 116, engages the lower extremity 118 of the duct 82. With the desired close fit it may be desirable to taper the lower extremity 118 of the duct 82 in order to permit it to be conveniently inserted into the sleeve 115. This can be done by snipping a tapered slot 119 at each corner and then bending the portion of the duct between the end slots with a hand brake.

With the sleeve 115 positioned over the connector duct 82 and having been slid to its uppermost position, the insert 11 can be readily received within the recess 15.

When properly positioned, the installer can reach through the firebox 120 and upwardly through the vent 75 to grasp the crosspin 116 and slide the sleeve 115 downwardly so that the lower extremity 121 therof, which may also be tapered similarly to the lower extremity 118 of the duct 82, will conveniently enter the vent 75.

It should be appreciated that the sleeve 115 may, with equal facility, be fabricated so as to be slidably receivable within the duct 82, but in that situation the upper extremity of the sleeve 115 would be tapered rather than the lower extremity of duct 82.

This completes the description as to the positive interconnection between the vent 75 of the insert 11 and the damper frame 12, and it should now be apparent that any shroud (not shown) employed between the facing 18 of the fireplace and insert 11 will strictly be for purposes of decoration; it will serve no sealing function and can therefore be rather easily positioned as by means well known to those skilled in the art.

Figure 4:
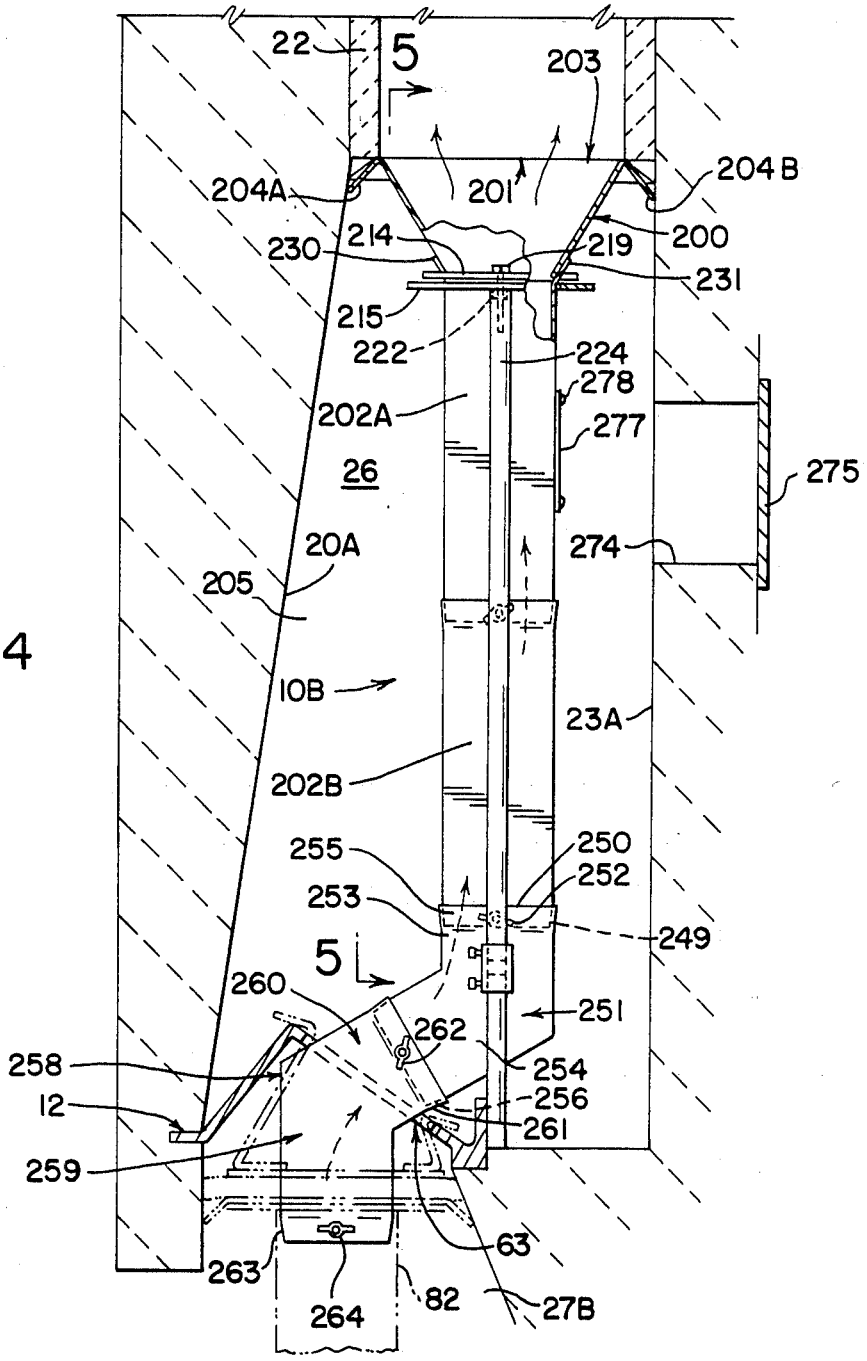
FIG. 4 is a vertical cross-section depicting that portion of a positive interconnect system embodying the concept of the present invention connected between the damper and the flue.
Figure 5:
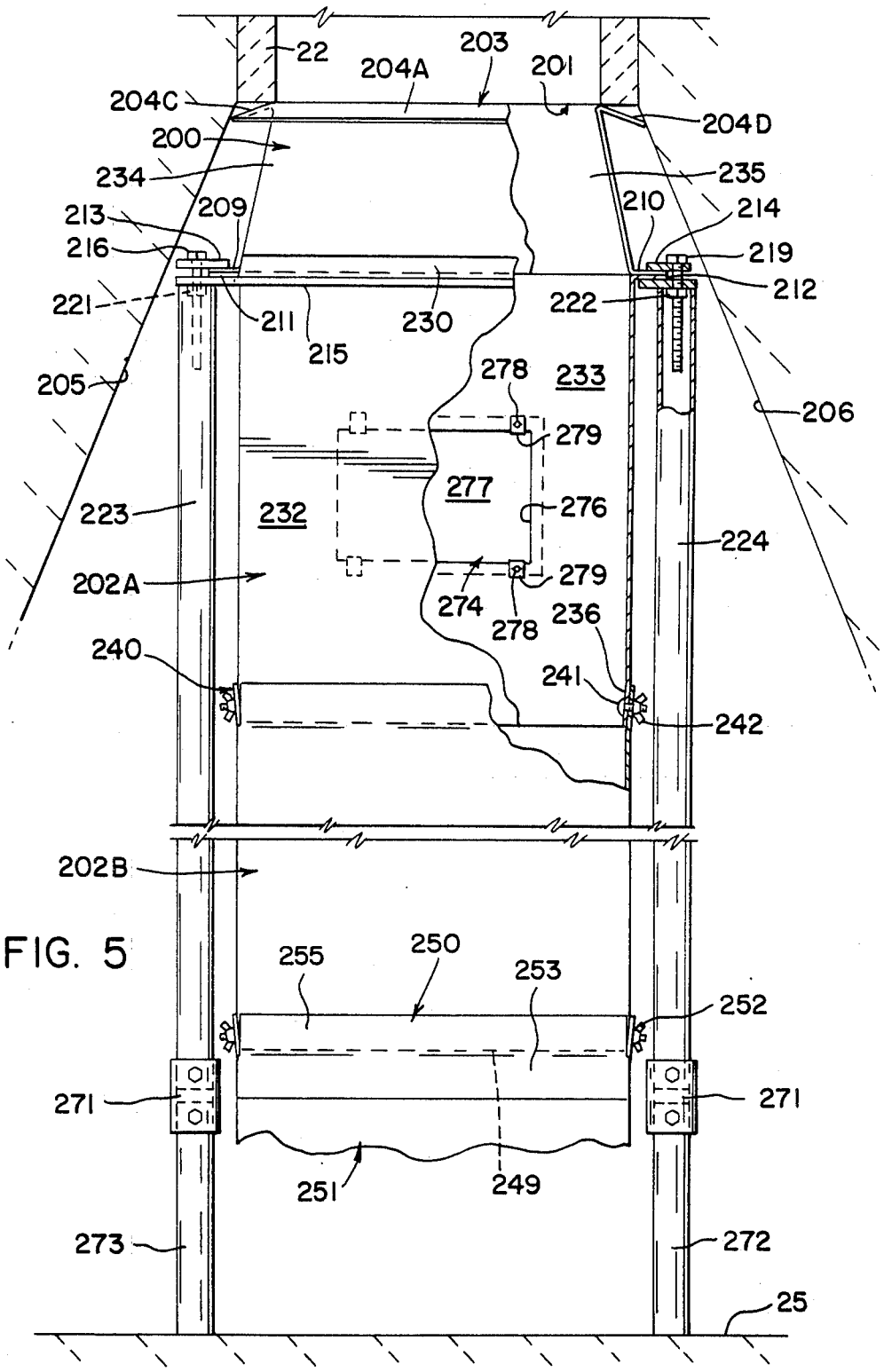
FIG. 5 is an enlarged, transverse, vertical cross-section taken substantially along line 5—5 of FIG. 4.
Figure 6:
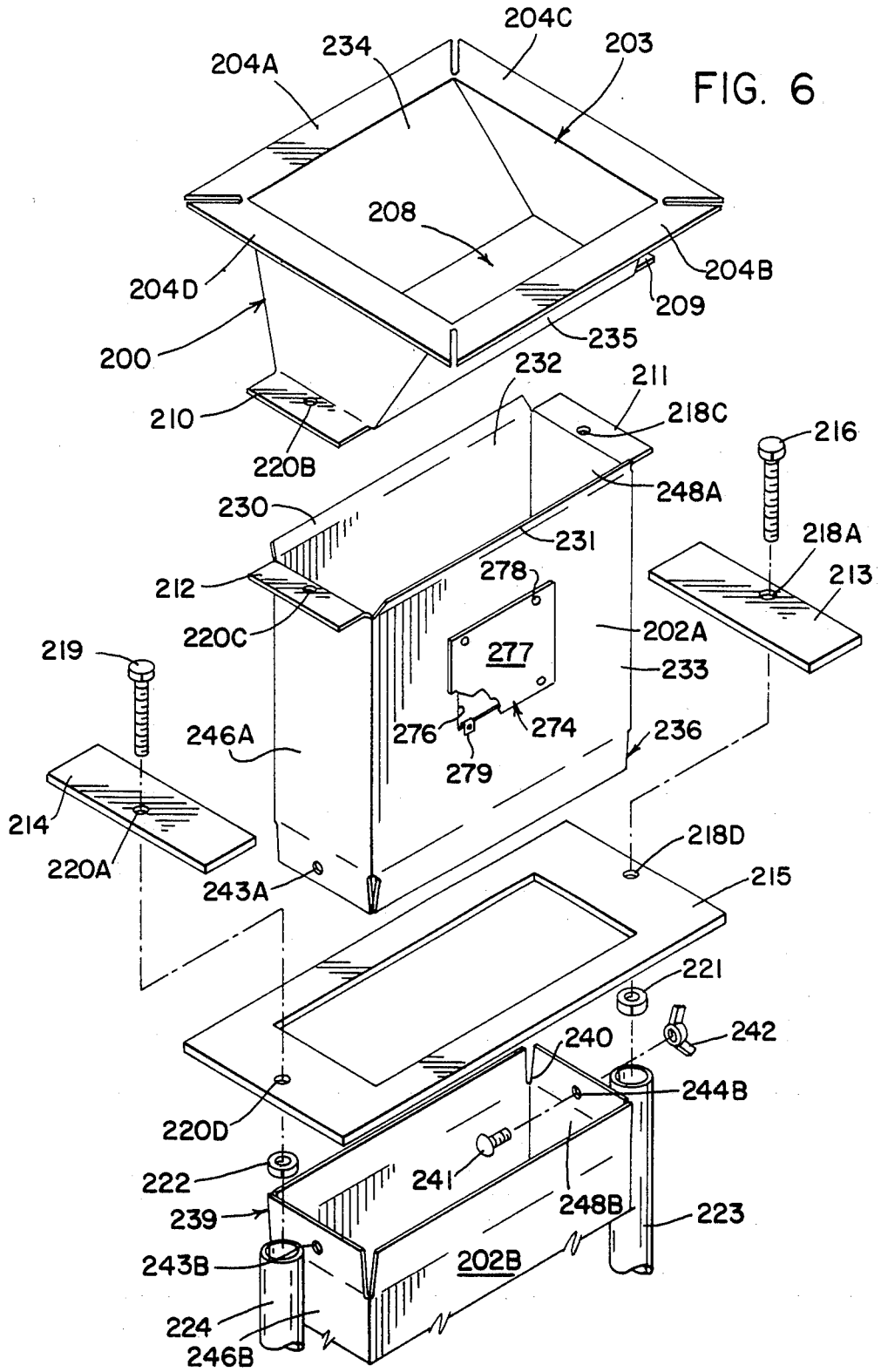
FIG. 6 is an exploded perspective of those elements employed by that portion of the positive interconnect system depicted in FIGS. 4 and 5 that effect the connection to the flue.

The secondary portion 10B of the positive interconnect system 10, the overall details of which are best seen in FIGS. 4 through 6, extends from the primary portion 10A to the flue liner 22.

In most residential chimneys the flue liner is of square cross-section, measuring generally 8 by 8 inches (20.23×20.23 cm) or 12 by 12 inches (30.48×30.48 cm). There are some flue liners of rectangular cross-section, but if one understands the construction of the secondary portion 10B as applied to the flue liners of square cross-section, that understanding will permit the present invention to be readily adapted to flue lines of rectilinear cross-section.

Referring most particularly to FIGS. 4 and 5, an adaptor boot 200 is interposed between the mouth 201 of the flue liner 22 and the standard duct member 202A which extends downwardly from the adaptor boot 200. Standard rectilinear duct work measuring 3½ by 14 inches (8.89 by 35.56 cm) is readily available and can be easily employed with the subject invention.

The uppermost opening 203 of the adaptor boot 200 conforms with the mouth 201 of the flue liner 22. For use in conjunction with, for example, an 8 by 8 inch (20.32 by 20.32 cm) flue liner the opening 203 would conform to those dimensions. A flap 204 projects transversely outwardly from the four sides of the opening 203. When the adaptor boot 200 is positioned with the opening 203 thereof in juxtaposition with the mouth 201 of the flue liner 22 the flap 204 will fold to engage the adjacent, converging walls of the smoke chamber 26. Accordingly, and as depicted in FIG. 4, the front flap portion 204A will engage the front, corbelled wall 20A and the rear flap 204B will engage the rear wall 23A. Similarly, and as best depicted in FIG. 5, the side flaps 204C and 204D will engage the corresponding converging sidewalls 205 and 206 of the smoke chamber 26.

The lowermost mouth 208 of the adaptor boot 200 conforms to the dimensions of the duct work employed, in the preferred embodiment this would be the standard 3½ by 14 inches (8.89×35.56 cm). A pair of connecting flanges 209 and 210 extend laterally from adjacent the mouth 208. The flaps 209 and 210 are disposed to overlie corresponding flanges 211 and 212, respectively, which extend laterally outwardly from the top of the duct member 202A, and each flange 209 and 210 is respectively provided with an overlying reinforcing plate 213 and 214. A stabilizing collar plate 215, in turn, underlies the mounting flanges 211 and 212 on the duct member 202A. A pair of bolts are employed to connect the adaptor boot 202 to the duct 202A. Specifically, bolt 216 extends through bore 218A in the reinforcing plate 213 and through the bore 218D in the collar plate 215. Similarly, a bolt 219 extends through bore 220A in the reinforcing plate 214 and through the bore 220D in the collar plate 215. In the arrangement just described the flanges 209 and 210 on the adaptor boot 200 as well as the flanges 211 and 212 on duct 202A are merely embraced between the reinforcing plates 213 and 214 and the collar plate 215, in which situation the bores 218A and 220A may preferably be disposed laterally outwardly from the center of the reinforcing plates 213 and 214, respectively, as depicted in FIG. 6. However, it is equally feasible, if desired, to pass the bolt 216 through bore 218B in flange 209 on adaptor boot 200 and bore 218C in the flange 211 on duct 202A. Similarly, bolt 219 may be passed through bore 220B in flange 210 on the adaptor boot 200 and through the bore 220C in the flange 212 on duct 202A.

Nuts 221 and 222 are, respectively, tightened to sandwich the relatively thin flanges of the adaptor boot 200 and duct 202A between the sturdy reinforcing plates 213 and 214 and the underlying collar plate 215. This not only secures the duct 202A to the adaptor boot 200, but it also provides a rigid connection by which the entire secondary portion 10B of the positive interconnect system 10 can be manipulated, as required, during installation, as will be hereinafter more fully described.

This latter function is assisted by employing bolts 216 and 219 that are at least an inch (2.54 cm) or so longer than required to effect the aforedescribed connection. As such, the overlength of each is available to be insertably received within a length of thin-walled electrical conduit 223 and 224 for the purposes that will be more fully understood in conjunction with hereinafter described installation procedure.

Fore and aft centering of the duct 202A with respect to the adaptor boot 200 during assembly can be facilitated by locating flanges 230 and 231 which flare outwardly from the fore and aft walls 232 and 233 of the duct 202A to engage the respective corresponding fore and aft walls 234 and 235 of the adaptor boot 200.

The duct 202A can be commercially acquired in 11 inch (27.94 cm) lengths, and the lowermost extremity 236 thereof may be tapered in order to permit it to be conveniently inserted into the next successive element of the secondary portion 10B of the positive interconnect 10. In that regard the lowermost extremity 236 of the duct 202A may be conveniently tapered in the same manner as heretofore described with respect to the connector duct 82.

The next successive element may well be a second duct section 202B that is virtually identical to duct 202A except that the uppermost extremity 239 of duct 202B is only modestly flared, as at 240, to assist in receiving the lowermost extremity 236 of duct 202A. With the duct 202A insertably received within the uppermost extremity of duct 202B a pair of short bolts 241 and wing nuts 242 may be secured through bores 243 (A and B) and 244 (A and B) in the corresponding sidewalls 246 (A and B) and 248 (A and B) to secure the ducts 202A and 202B together.

The lowermost extremity 249 of the duct 202B is tapered similarly to the taper on the lowermost extremity 236 of duct 202A so that the extremity 249 of duct 202B can be insertably received within the upper extremity 250 of a short-legged, 45-elbow 251, as is best depicted in FIG. 4. The upper extremity 250 of the short-legged, 45-elbow 251 may preferably be flared to facilitate insertion of the duct 202B within the short-legged, 45-elbow 251. A pair of bolt and wing nut combinations 252 may also be employed to secure the 45-elbow 251 to the duct 202B.

A typical, short-legged, 45-elbow 251 has one leg 253 that may be on the order of three inches (7.62 cm) in length, and a second leg 254 that may be on the order of five inches (12.7 cm) in length. As depicted, the duct 202B is insertably secured within the shorter of the two legs, the opening of which may be flared, as at 255, to facilitate their interconnection.

The opening of the longer 254 of the two legs forming the 45-elbow 251 would, in that situation, be tapered, as at 256, to facilitate its insertable connection to a long-legged 45-elbow 258.

A typical, long-legged, 45-elbow 258 has one leg 259 that may be on the order of eight inches (20.32 cm) in length, and a second 260 that may be on the order of five inches (12.7 cm) in length. In the representative embodiment depicted, the leg 254 of the 45-elbow 251 is insertably received within the shorter leg 260 of the 45-elbow 258, the opening of said leg 260 being flared, as at 261, to facilitate the insertable connection. Here, too, bolt and wingnut combinations 262 may be employed to secure the connection.

The longer leg 259 of the 45-eblow 258 extends downwardly from about the level of the opening 63 of the damper frame 12 and may preferably be conjoined to the connector duct 82. This connection is facilitated by tapering the opening of leg 259 as at 263, and once again a bolt and wing nut combination 264 may be employed to secure the secondary portion 10B to the primary portion 10A.

It will be observed that as to each connection made in conjoining the components of the system 10, the upper element is insertably received within the next adjacent lower element. By this arrangement any fluids, such as creosote, will not readily escape to cause a hazard exteriorly of the system. Rather, any such hazardous liquids will be retained within the system where they can be readily detected by visual inspection and from which they can be readily removed.

Those skilled in the art will appreciate that the lengths of the various components may be varied, as required, to accommodate a specific installation. However, perhaps the unique quality of the secondary portion 10B may best be appreciated by an understanding as to how the components are actually assembled, in situ, within the smoke chamber 26. To that end reference should be made to FIGS. 7A through 7E.

First, it must be appreciated that every element of the secondary portion 10B to be employed within the smoke chamber 26 must be inserted through the limited opening 63 of the damper frame 12. Whereas the lateral length of a typical, domestic, damper opening may vary from 18 inches (45.72 cm) to 47 inches (119.38 cm) that dimension is by far the larger of the dimensions for the damper opening 63. The opening 63, measured across its front to rear incline directly from the forward edge 64 to the rearward edge 68 thereof, will vary from slightly less than five inches (12.7 cm) to an absolute maximum of approximately nine and one half inches (24.13 cm). This dimension, then, forms an absolute restriction on the size of any component one attempts to insert into the smoke chamber 26.

Figure 7A:
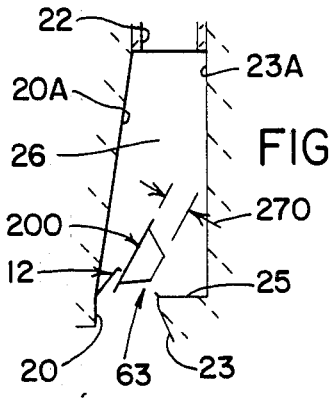
FIGS. 7A–7E are schematic, vertical cross-sections through a chimney depicting, in sequence and in side elevation, the insertion and assembly of that portion of the positive interconnect system depicted in FIGS. 4 through 6.

Inasmuch as the average size of the upper opening 203 of the adaptor boot 200 exceeds perhaps even the widest damper opening 63 one is likely to encounter, the adaptor boot 200 is made so that its vertical dimension, as schematically depicted at 270 in FIG. 7A, will be less than even the smallest damper opening 63 one might encounter. To that end the dimension 270 is preferably only about four inches (10.16 mm) so that the adaptor boot 200 may be inserted sideways through the damper opening 63.

Figure 7B:
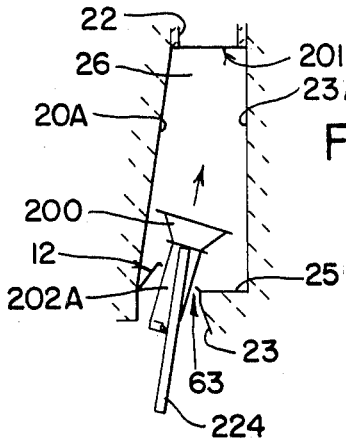

Once the adaptor boot 200 has passed through the damper opening 63 it can be easily manipulated within the smoke chamber 26 so that the duct 202A can be connected thereto. After the nuts 221 and 222 are tightened securely on their respective bolts 216 and 219, two lengths of thin-walled electrical conduit 223 and 224 are received over the extra extension of the bolts 216 and 219 to permit the conjoined adaptor boot 200 and duct 202A to be extended into the smoke chamber 26 toward the opening 201, as depicted in FIG. 7B, by virtue of the thin-walled conduit 223 and 224 acting as handle means.

Figure 7C:
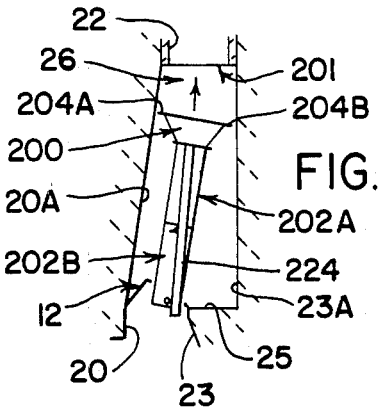

When the adaptor boot 200 and duct 202A are inserted to a convenient extent the duct 202B is then connected to duct 202A, and the thus assembled components of secondary portion 10B are further extended upwardly within the smoke chamber 26 toward the opening 201 of the flue liner 22, as depicted in FIG. 7C. At about this point the flap 204 of the adaptor boot 200 begins to contact one or more of the converging walls of the smoke chamber 26 as they narrow toward the opening 201 of the flue liner 22. It is then that the real benefit of the "handles" formed by the conduit 223 and 224 begins to be more fully appreciated. Moreover, as the flaps 204 engage the walls of the smoke chamber 26 the need for the strength imparted by the collar plate 215 and the reinforcing plates 213 and 214 should also be appreciated inasmuch as they stabilize the assembly and distribute the forces applied by the installer as the assembly is forced upwardly to fold the flaps 204.

Figure 7D:
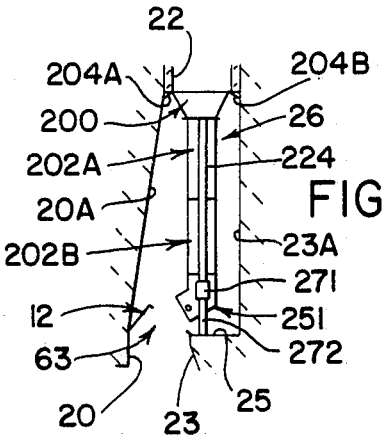

When the assembly depicted in FIG. 7C is at a convenient height the 45-elbow 251 is secured to the duct 202B by virtue of the nut and wingbolt combinations 252. This may be either before or after the adaptor boot 200 is fully seated at the mouth 201 of the flue liner 22. In either event a compression connector 271 is secured to each length of thin-walled conduit 223 and 224. The distance between the shelf 25 and the connector 271 is then measured and two short lengths 272 and 273 of thin-walled conduit are cut, one being inserted in each compression connector 271, and the free ends of the short lengths of the thin-walled connector 272 and 273 are thereafter wedged against the shelf 25, as depicted in FIG. 7D, to maintain the secondary portion 10B in the desired vertical position within the smoke chamber 26.

Figure 7E:
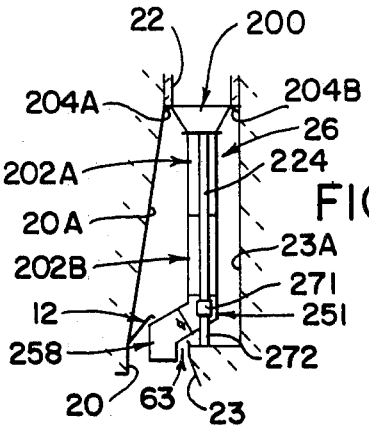

Thereafter, the final, long-legged, 45-elbow 258 is secured to the short-legged, 45-elbow 251, as depicted in FIG. 7E. This concludes the installation of the secondary portion 10B and the primary portion 10A may thereafter be installed, as previously herein described.

The National Fire Prevention Association (NFPA) requests that a means should be provided for inspection to determine creosote build-up, and many states are adopting the NFPA recommendation. In most prior arrangements the insert must be removed. However, by providing an access port 274 in portion 10B on substantially the same level as an access door 275 through the rear wall 23A of the smoke chamber 26, the requisite inspection can be achieved without removal of the insert 11.

The access port 274 may merely comprise an aperture 276 within the duct 202A. A cover plate 277 closes the aperture 276 and can be demountably secured to the duct 202A as by a plurality of sheet metal screws 278 threadably received within corresponding clip-mounted, speed nuts 279 mounted from the rim of the aperture 276.

All considered, it should now be apparent that the herein described construction provides a positive interconnection extending at least between the fireplace insert and the damper, and in addition, a compatible arrangement may be employed between the damper and the flue liner. The entire system can readily accommodate wide dimensional variations, can be manufactured and installed relatively inexpensively, and with standard hand tools, and can otherwise accomplish the objects of the invention.

I claim:

1. A positive interconnection for an insert having an exhaust vent to be received within a fireplace having a damper frame and a flue disposed upwardly thereof comprising:

a support frame;

a plurality of Z-bars of preselected length whereby to suspend said support frame from the damper frame; said Z-bars being mounted in paired opposition on said support frame, each Z-bar having a diagonal arm, and each pair of Z-bars having one shorter and one longer diagonal;

means being provided by which to connect each Z-bar to said support frame;

said means by which to connect each Z-bar to said support frame permitting each opposed pair of Z-bar hangers to be moved toward and away from each other to permit facile engagement thereof with the damper frame and also to permit fore and aft adjustability in the location of said support frame;

a connector duct means to interconnect said support frame to the exhaust vent;

means by which to secure said connector duct to said support frame, said means by which to secure said connector duct to said support frame being wholly separate and distinct from said hanger means; and, means by which to effect a seal between the connector duct and the fireplace upwardly of the insert.

2. A positive interconnection for an insert having an exhaust vent to be received within a fireplace having a damper frame and a flue disposed upwardly thereof comprising:

a support frame;

a plurality of hanger means to suspend said support frame from the damper frame;

a sealing plate being disposed beneath said support frame;

a connector duct means to interconnect said support frame to the exhaust vent;

means by which to secure said connector duct to said support frame, said means by which to secure said connector duct to said support frame being wholly separate and distinct from said hanger means; and, a bat of high temperature insulation being interposed between said sealing plate and said support frame, said sealing plate being connected to said support frame by virtue of the means by which said connector duct is secured to said support frame.

3. A positive interconnect, as set forth in claim 2, wherein at least a pair of mounting flanges extend transversely outwardly of said connector duct and a retainer plate is employed to secure the said insulation bat, the sealing plate and said mounting flanges by sandwiching said elements between said retainer plate and said support frame.

4. A positive interconnect, as set forth in claim 3, wherein a sleeve means is slidably mounted on said connector duct to effect an extension of the latter whereby selectively to engage and disengage with the vent on the fireplace insert.

5. A positive interconnect, as set forth in claim 2, wherein duct means form a closed conduit from said connector duct to the flue.

6. A positive interconnection for an insert having an exhaust vent to be received within a fireplace having a damper frame and a flue disposed upwardly thereof comprising:

a support frame;

a plurality of hanger means to suspend said support frame from the damper frame;

a connector duct means to interconnect said support frame to the exhaust vent;

means by which to secure said connector duct to said support frame, said means by which to secure said connector duct to said support frame being wholly separate and distinct from said hanger means;

means by which to effect a seal between the connector duct and the fireplace upwardly of the insert duct;

means to form a closed conduit from said connector duct to the flue;

an adaptor boot to connect said duct means to the flue, said adaptor boot having first and second opposed end openings and a vertical dimension therebetween;

said first end opening of the adaptor boot having dimensions which correspond with the dimensions of the flue and said second end opening having dimensions which correspond with the dimensions of said duct means;

flaps extend transversely outwardly of the first said opening of said adaptor boot to effect a seal between said adaptor boot and the flue;

the vertical dimension of said adaptor boot being at least less than the narrowest dimension of the damper frame to permit insertion therethrough;

a stabilizing collar means being employed in conjunction with said second end opening in said adaptor boot; and, manipulating handle means inter-engaging said stabilizing collar to force the said first end opening toward said flue and to force-fold said sealing flap.

7. A positive interconnect, as set forth in claim 6, wherein extension means are connected to said manipulating means to provide a wedging support for said adaptor boot.

8. A positive interconnect, as set forth in claim 7, wherein said duct means comprises a successive series of ducts and elbows of convenient length, the adjacent ends of which are respectively tapered and flared for insertable interconnection.

9. A positive interconnect, as set forth in claim 8, wherein each duct and elbow in the successive series thereof is insertably received within the next successive lower duct or elbow in the successive series forming the duct means to preclude the exiting flow of any liquid.

* * * * *